US007853169B2

(12) United States Patent
Konishi

(10) Patent No.: US 7,853,169 B2
(45) Date of Patent: Dec. 14, 2010

(54) ROLLER MEMBER URGING MECHANISM AND IMAGE FORMING APPARATUS

(75) Inventor: Hidehisa Konishi, Osaka (JP)

(73) Assignee: Kyocera Mita Corporation (JP)

( * ) Notice: Subject to any disclaimer, the term of this patent is extended or adjusted under 35 U.S.C. 154(b) by 501 days.

(21) Appl. No.: 11/978,789

(22) Filed: Oct. 30, 2007

(65) Prior Publication Data

US 2008/0101824 A1 May 1, 2008

(30) Foreign Application Priority Data

Oct. 31, 2006 (JP) ..... 2006-295098

(51) Int. Cl.
*G03G 15/00* (2006.01)
*G03G 15/16* (2006.01)

(52) U.S. Cl. ..... 399/90; 399/313; 439/17

(58) Field of Classification Search ..... 399/90, 399/313; 439/862, 92, 17, 29, 13
See application file for complete search history.

(56) References Cited

U.S. PATENT DOCUMENTS 6,315,620 B1 * 11/2001 Moir et al. ..... 439/862
2005/0220476 A1 * 10/2005 Kakitani et al. ..... 399/90
2005/0254854 A1 * 11/2005 Deguchi ..... 399/313
2005/0271416 A1 * 12/2005 Kinoshita et al.

FOREIGN PATENT DOCUMENTS

JP 09319239 A * 12/1997
JP 2000-250333 9/2000

* cited by examiner

*Primary Examiner*—Susan S Lee
(74) *Attorney, Agent, or Firm*—Gerald E. Hespos; Michael J. Porco

(57) ABSTRACT

A roller member urging mechanism includes: a roller member having a roller shaft and coming in contact with a predetermined member; a casing for holding the roller member, the casing being electrically insulative; a bearing for receiving the roller shaft, the bearing being provided in the casing slidably in a direction substantially orthogonal to the roller shaft of the roller member, the bearing being electrically conductive; and a strip member provided in the casing near the bearing and serving as a contact for supplying electricity to the roller member. The strip member being a spring-like single member operable to come in contact with the bearing to press the roller member against the predetermined member through the bearing.

10 Claims, 8 Drawing Sheets

ROLLER MEMBER URGING MECHANISM AND IMAGE FORMING APPARATUS

BACKGROUND OF THE INVENTION

1. Field of the Invention

The present invention relates to a roller member urging mechanism and an image forming apparatus provided with the same.

2. Description of the Related Art

In a conventional image forming apparatus such as a color printer, an urging mechanism pushes a transferring roller arranged under a transferring belt upward so as to allow the transferring roller come in press contact with the transferring belt, so that a transferring processing is performed assuredly when an image is transferred from a photoconductive drum to the transferring belt, or from the transferring belt to a recording sheet.

FIGS. 8 and 9 show a conventional urging mechanism for a transferring roller. This transferring roller 116 (refer to FIG. 9) is retained on a casing 109 being electrically insulative. The casing 109 is provided with a bearing 108 being electrically conductive for receiving a roller shaft 116*b* of the transferring roller 116, and a strip member 110 which serves as a contact to an unillustrated other unit to supply electricity to the transferring roller 116 through the bearing 108. A coil spring 111 is arranged between the strip member 110 and the bearing 108. The coil spring 111 pushes up the transferring roller 116 along with the bearing 108 to allow the transferring roller 116 to come in press contact with a transferring belt and the like.

Further, in Japanese Patent Unexamined Publication No. 2000-250333, there is disclosed an urging mechanism having a strip member formed with a projecting portion on its upper surface and a coil spring arranged between the projecting portion and a bearing in a compressed state. In this urging mechanism, the transferring roller axially supported on the bearing member is supplied with electricity and pushed up.

However, since a coil spring and a strip member are used for supplying electricity to a transferring roller and pushing up the transferring roller in the conventional urging mechanisms, it is difficult to reduce the number of parts. Further, since there are provided many parts constituting a passage for supplying electricity to the transferring roller, malfunction in electric current is likely to occur.

SUMMARY OF THE INVENTION

An object of the present invention is to provide a roller member urging mechanism capable of reducing the number of parts and suppressing occurrence of malfunction in electric current, and to provide an image forming apparatus provided with the roller member urging mechanism.

A roller member urging mechanism according to one aspect of the present invention accomplishing the object comprises: a roller member having a roller shaft and coming in contact with a predetermined member; a casing for holding the roller member, the casing being electrically insulative; a bearing for receiving the roller shaft, the bearing being provided in the casing slidably in a direction substantially orthogonal to the roller shaft of the roller member, the bearing being electrically conductive; and a strip member provided in the casing near the bearing and serving as a contact for supplying electricity to the roller member. The strip member is a spring-like single member operable to come in contact with the bearing to press the roller member against the predetermined member through the bearing.

Further, the image forming apparatus according to another aspect of the present invention includes a sheet supplying portion for supplying a sheet and a transferring roller for transferring an image onto a sheet supplied by the sheet supplying portion, and the above-described urging mechanism is provided therein as an urging mechanism for the transferring roller.

These and other objects, features and advantages of the present invention will become more apparent upon reading of the following detailed description along with the accompanied drawings.

DETAILED DESCRIPTION OF THE PREFERRED EMBODIMENTS

Figure 1:
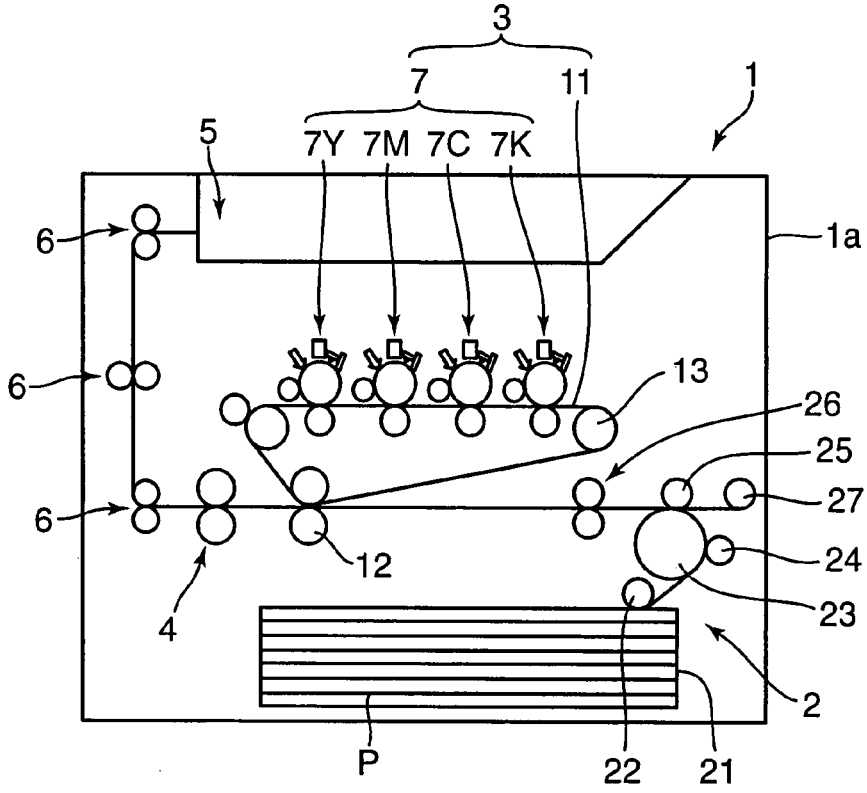
FIG. 1 is a sectional view showing an overall configuration of a color printer according to an embodiment of the present invention.
Figure 2:
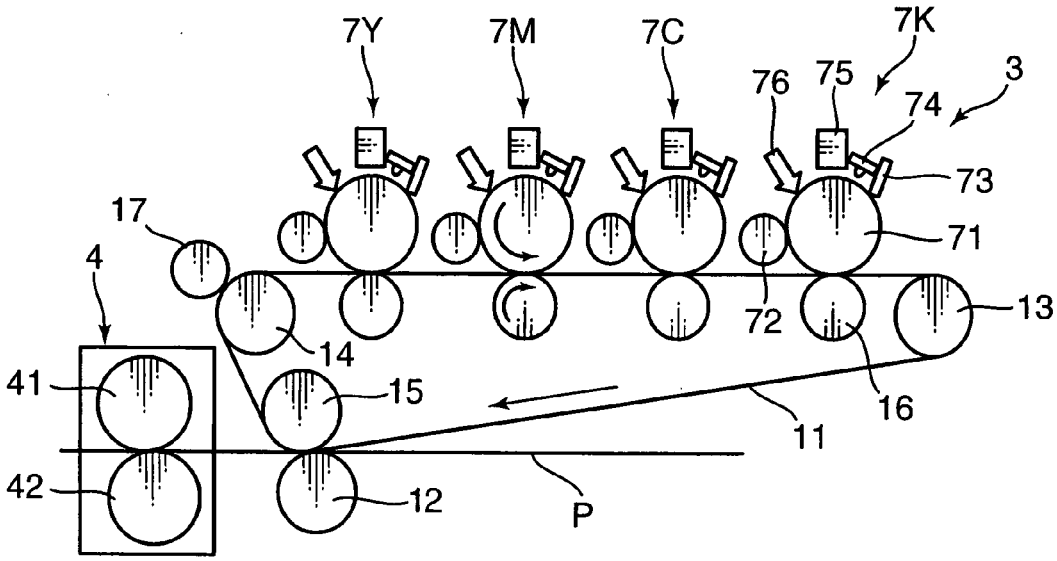
FIG. 2 is an enlarged view showing a relevant part of a configuration in a periphery of an image transferring portion of the color printer.
Figure 3:
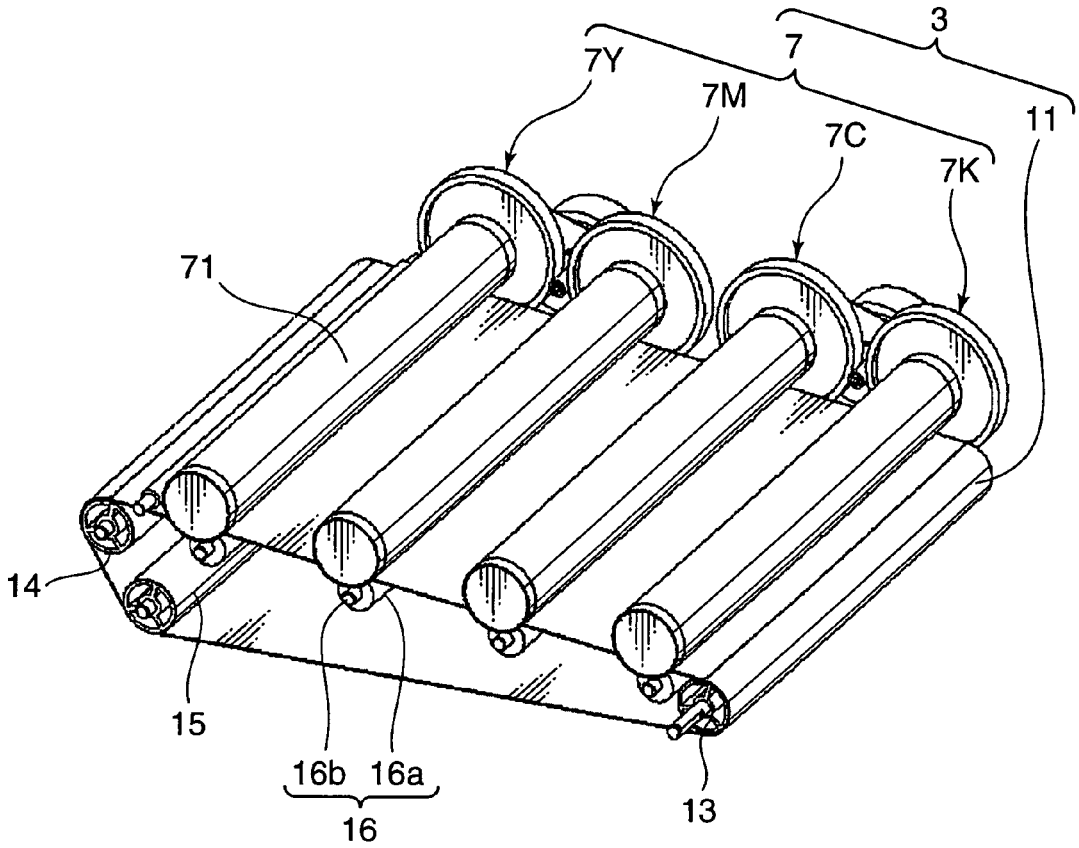
FIG. 3 is a perspective view schematically showing the image transferring portion shown in FIG. 2.

Hereinafter, an embodiment of the present invention will be described with reference to the drawings. FIG. 1 is a sectional view showing an overall configuration of a color printer according to an embodiment of the present invention. FIGS. 2 and 3 show a configuration of an image transferring portion of the color printer. Further, FIGS. 4 to 7 show a configuration of a lifting mechanism for a primary transferring roller. Firstly, an overall configuration of a tandem color printer 1 according to the embodiment of the present invention will be described with reference to FIGS. 1 to 3.

As shown in FIG. 1, the color printer 1 has a box-shaped apparatus main body 1*a*. In the apparatus main body 1*a*, there are provided a sheet supplying portion 2 including a detachable sheet supplying cassette 21 for storing a recording sheet P, an image transferring portion 3 for conveying a recording sheet P taken out from the sheet supplying cassette 21 in accordance with driving of the sheet supplying portion 2 and transferring an image onto the recording sheet P, and a fixing portion 4 for applying a fixing processing to the image transferred to the recording sheet P by the image transferring portion 3. On an upper surface of the apparatus main body 1*a*, there is provided a sheet discharging portion 5 to which the recording sheet P fixed with the image by the fixing portion 4 is discharged.

The sheet supplying portion 2 takes out recording sheets P stored in the sheet supplying cassette 21 one after another by driving of a pickup roller 22 provided at an upper right position of the sheet supplying cassette 21 as illustrated in FIG. 1, and sends out the recording sheets P to a sheet conveying path by using sheet feeding rollers 23, 24 and 25. Further, after a registration roller 26 allows the recording sheet P to wait temporarily, the sheet supplying portion 2 supplies the recording sheet P to the image transferring portion 3 at a predetermined timing.

Further, the sheet supplying portion 2 has an unillustrated manual feeding tray which can be attached to a front surface of the apparatus main body 1*a*, and is capable of taking out recording sheets P placed on the manual feeding tray by using a pickup roller 27 and sending the sheets one after another to a sheet conveying path by using the sheet feeding rollers 23 and 25.

As shown in FIGS. 2 and 3, the image transferring portion 3 includes image transferring units 7, an intermediate transferring belt 11 (predetermined other member) having a surface (contact surface) onto which a toner image is transferred by the image transferring units 7, and a secondary transferring roller 12 for transferring the image formed on the intermediate transferring belt 11 to a recording sheet P having been sent from the sheet supplying cassette 21. The secondary transferring roller 12 is provided at a direct underneath position of the image transferring unit 7.

The image transferring units 7 include a yellow unit 7Y, magenta unit 7M, a cyan unit 7C, and a black unit 7K which are arranged sequentially from the upstream side (left side in FIG. 1) to the downstream side. The units 7Y, 7M, 7C, and 7K are so positioned and mounted that they are in a predetermined relative positional relationship with respect to devices in the apparatus main body 1*a*.

As shown in FIG. 2, each of the units 7Y, 7M, 7C, and 7K is provided with a photoconductive drum 71 as an image bearing member at its respective central position, and a developing device 72 is provided on left in FIG. 2 of each photoconductive drum 71. Then, the developing device 72 supplies toner particles onto a peripheral surface of the photoconductive drum 71 rotating in a counterclockwise direction so that a toner image is formed on the photoconductive drum 71.

At an upper right position in FIG. 2 of each photoconductive drum 71, there are provided a cleaning device 73 and a charge removing device 74 for removing remaining toner particles and electric charges from the peripheral surface of the photoconductive drum 71 and cleaning the same. Further, at a direct above position of the photoconductive drum 71, there is provided a charging device 75 such as a scorotron. After being cleaned by the cleaning device 73 and the charge removing device 74, the peripheral surface of the photoconductive drum 71 moves to the charging device 75 for new charging processing again.

At an upper left position of the photoconductive drum 71, there is provided an exposure device 76. The exposure device 76 irradiates a laser light in accordance with image data inputted by an unillustrated image reading device to the peripheral surface of the photoconductive drums 71 charged uniformly by the charging device 75 to form an electrostatic latent image on the peripheral surface of the photoconductive drum 71. Toner particles are supplied from the developing device 72 to the electrostatic latent image to form a toner image on the peripheral surface of the photoconductive drum 71. Then, the toner image is transferred to the intermediate transferring belt 11.

The intermediate transferring belt 11 is an endless elastic belt which extends between a driving roller 13, a driven roller 14, and a backup roller 15 so that its upper surface comes in contact with the respective peripheral surfaces of the photoconductive drums 71 at direct underneath positions of the units 7Y, 7M, 7C, and 7K.

At respective direct underneath positions of the photoconductive drum 71, there are provided primary transferring rollers 16 (roller members) through the intermediate transferring belt 11. Each of the primary transferring rollers 16 has a conductive roller main body 16*a* formed to be cylindrical and a conductive roller shaft 16*b* provided concentrically with the roller main body 16*a* and penetrating through an end wall of the roller main body 16*a*, and is capable of applying an electrical charge to a surface of the roller main body 16*a*. The primary transferring roller 16 is pushed upward by a lifting mechanism (urging mechanism) which will be described hereinafter, and the intermediate transferring belt 11 is pressed by these primary transferring rollers 16 so that it is prevented from separating from the photoconductive drum 71.

The primary transferring roller 16 is applied with a primary transfer bias voltage (having a polarity opposite to a charge polarity of toner particles). Driving of the driving roller 13 rotates the intermediate transferring belt 11 in a clockwise direction to allow the toner images formed on the photoconductive drum 71 to be sequentially transferred to the surface of the intermediate transferring belt 11 in superimposition by a pressing force of the primary transferring rollers 16. Then, a secondary transfer bias voltage having a polarity opposite to the toner image is applied to the secondary transferring roller 12 so that a color image formed on the surface of the intermediate transferring belt 11 is transferred to a recording sheet P between the secondary transferring roller 12 and the backup roller 15. This allows a color image to be transferred to the recording sheet P.

At an upper left position in FIG. 2 of the driven roller 14, there is provided a cleaning brush 17. The cleaning brush 17 removes toner particles remaining on the surface of the intermediate transferring belt 11 after the transferring processing of transferring a toner image to the recording sheet P is performed. Then, the surface of the intermediate transferring belt 11 cleaned by the cleaning brush 17 moves to the photoconductive drum 71.

The fixing portion 4 applies a fixing processing to a transferred image which is transferred to the recording sheet P by the image transferring portion 3, and includes a heat roller 41 which is heated by an electric heating body and a pressing roller 42 so provided as to face the heat roller 41 and whose peripheral surface comes in press contact with the peripheral surface of the heat roller 41.

The transferred image which has been transferred onto the recording sheet P by the secondary transferring roller 12 in the image transferring portion 3 is fixed to the recording sheet P by a fixing processing of heating the recording sheet P when it passes through a position between the heat roller 41 and the pressing roller 42. The recording sheet P to which the fixing processing is applied is discharged to the sheet discharging portion 5. Further, in the color printer 1 of the present embodiment, there is provided a conveying roller 6 at a proper portion between the fixing portion 4 and the sheet discharging portion 5.

Next, a lifting mechanism of the above-described primary transferring roller 16 will be described in detail with reference to FIGS. 4 to 7.

Figure 4:
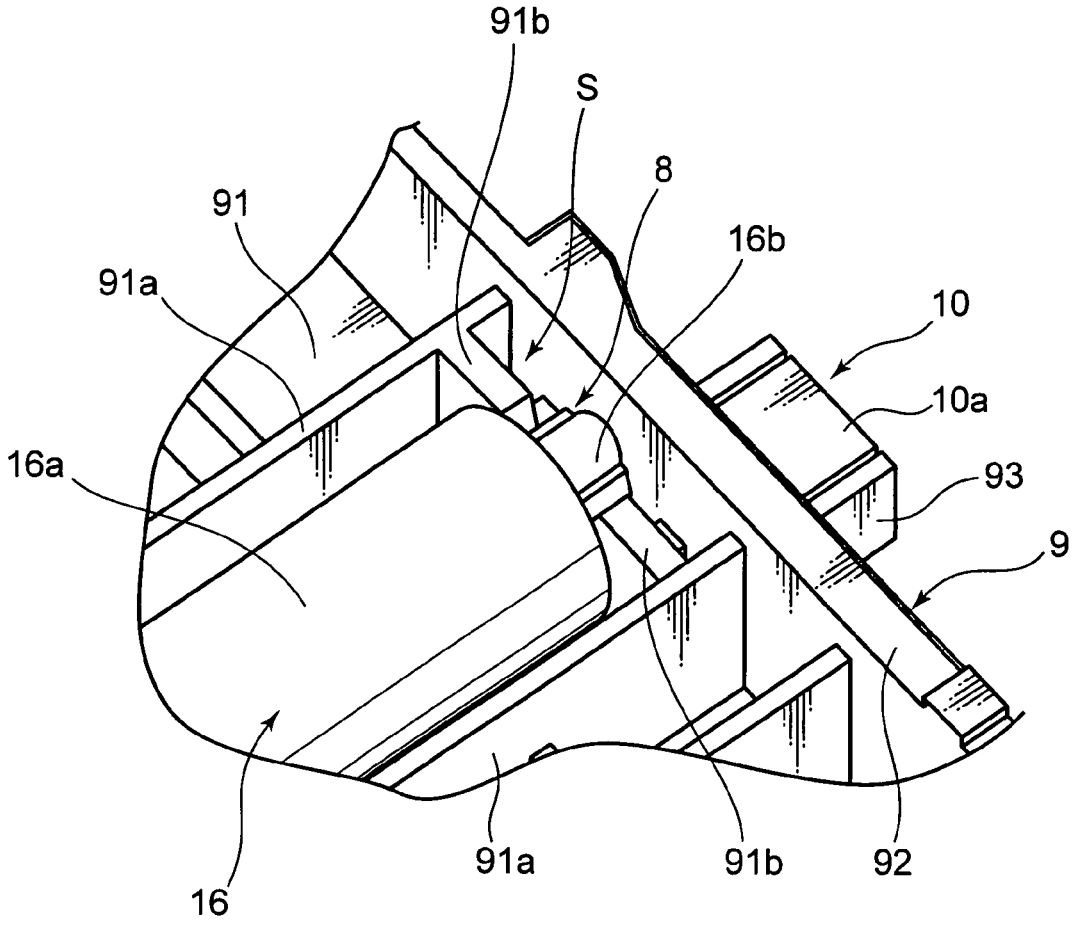
FIG. 4 is a perspective view showing a configuration of a lifting mechanism for a primary transferring roller.
Figure 5:
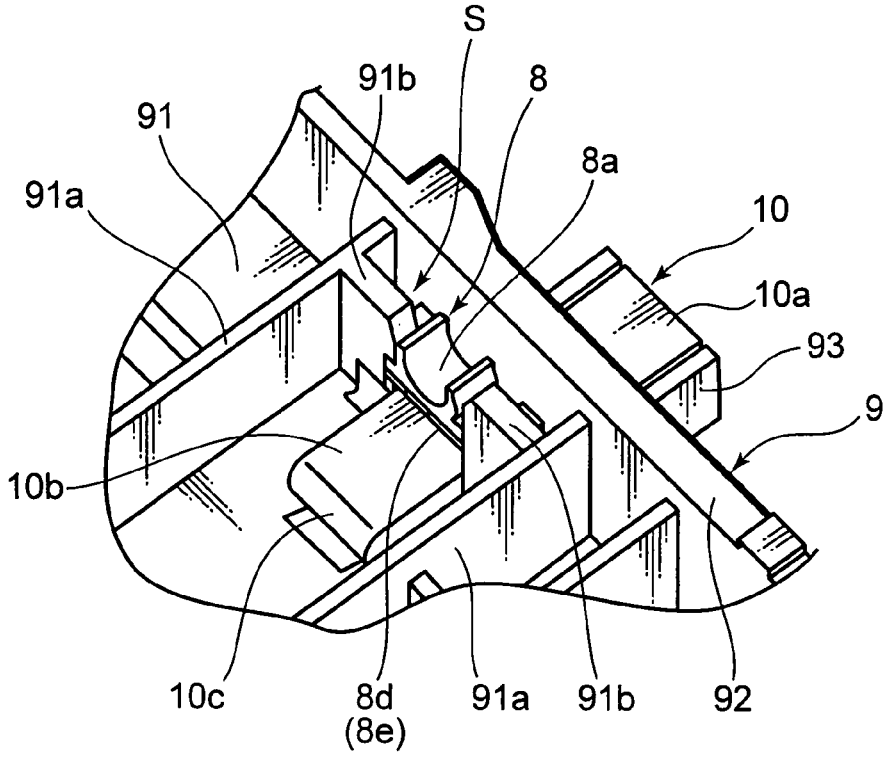
FIG. 5 is a perspective view showing a state where depiction of the primary transferring roller shown in FIG. 4 is omitted from the lifting mechanism for the primary transferring roller.
Figure 6:
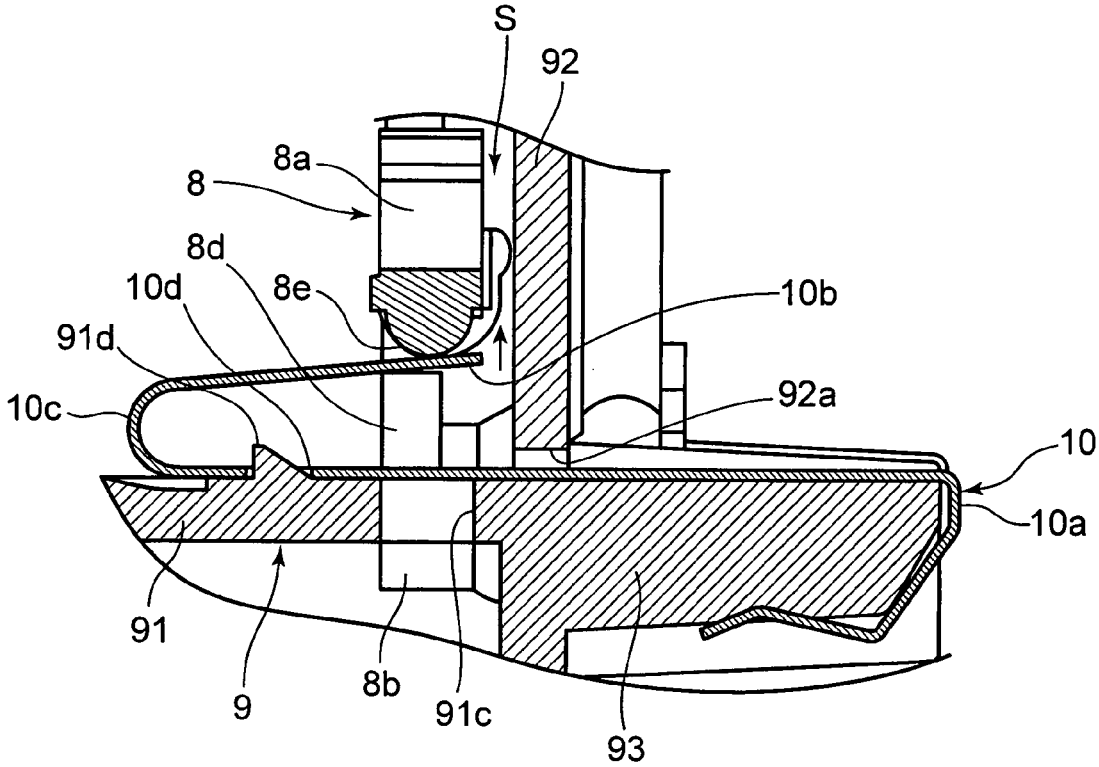
FIG. 6 is a sectional view showing a lifting mechanism for the primary transferring roller.

As shown in FIGS. 4 to 6, the lifting mechanism mainly includes a bearing 8 being electrically conductive, a casing 9 being electrically insulative, and a strip member 10 made of a stainless steel. Opposite ends of the roller shaft 16*b* of the primary transferring roller 16 are supported on the casing 9 through the bearings 8, respectively.

Figure 7:
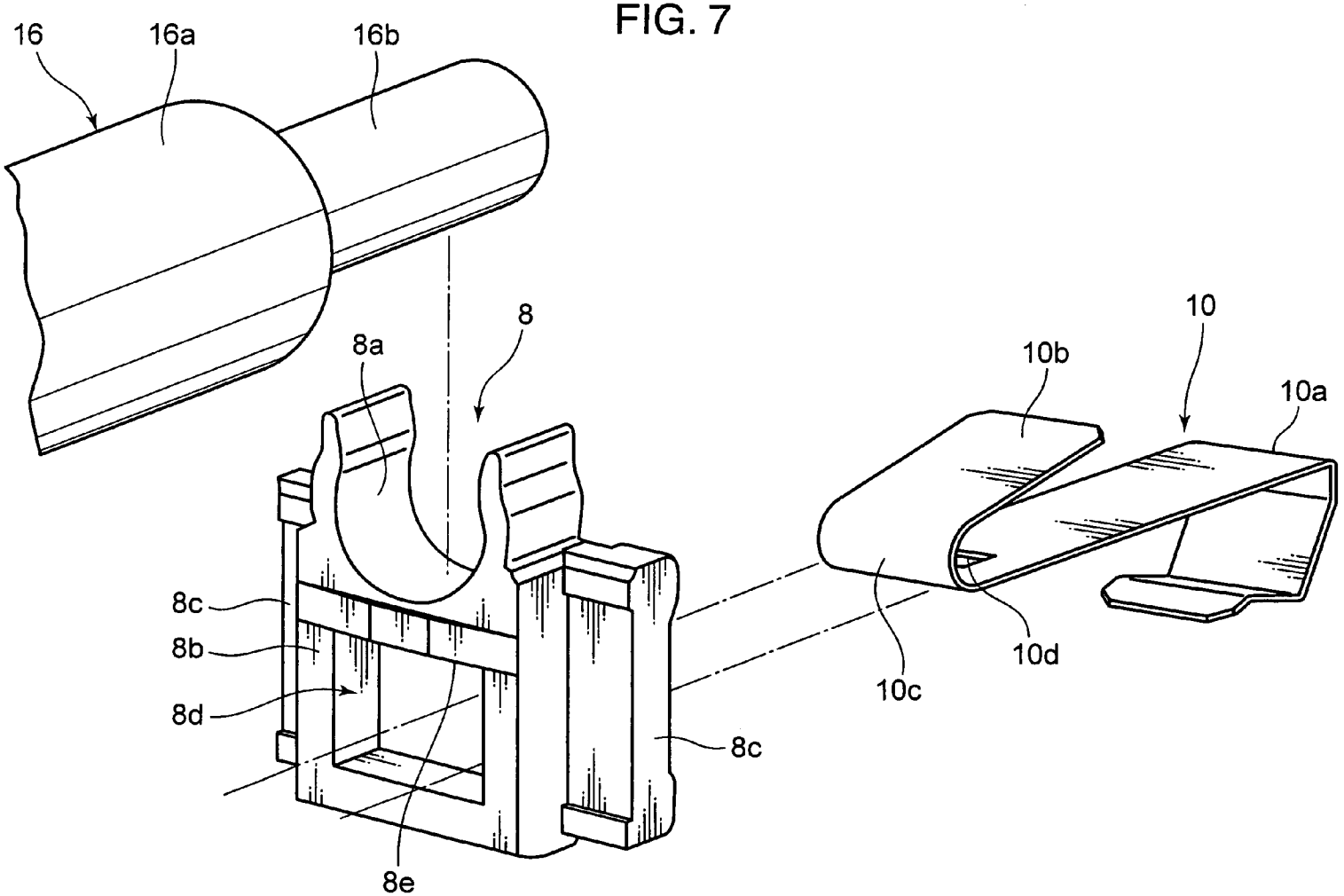
FIG. 7 is an exploded perspective view showing the primary transferring roller, a bearing and a strip member.
Figure 8:
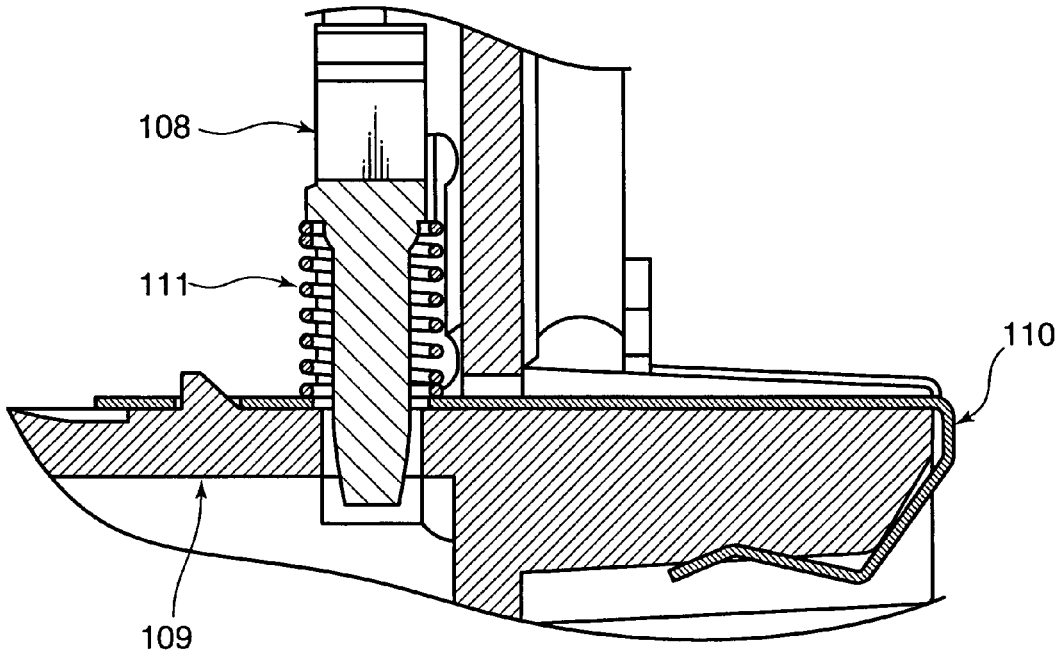
PRIOR ART FIG. 8
FIG. 8 is a sectional view showing a configuration of a conventional lifting mechanism for a transferring roller.
Figure 9:
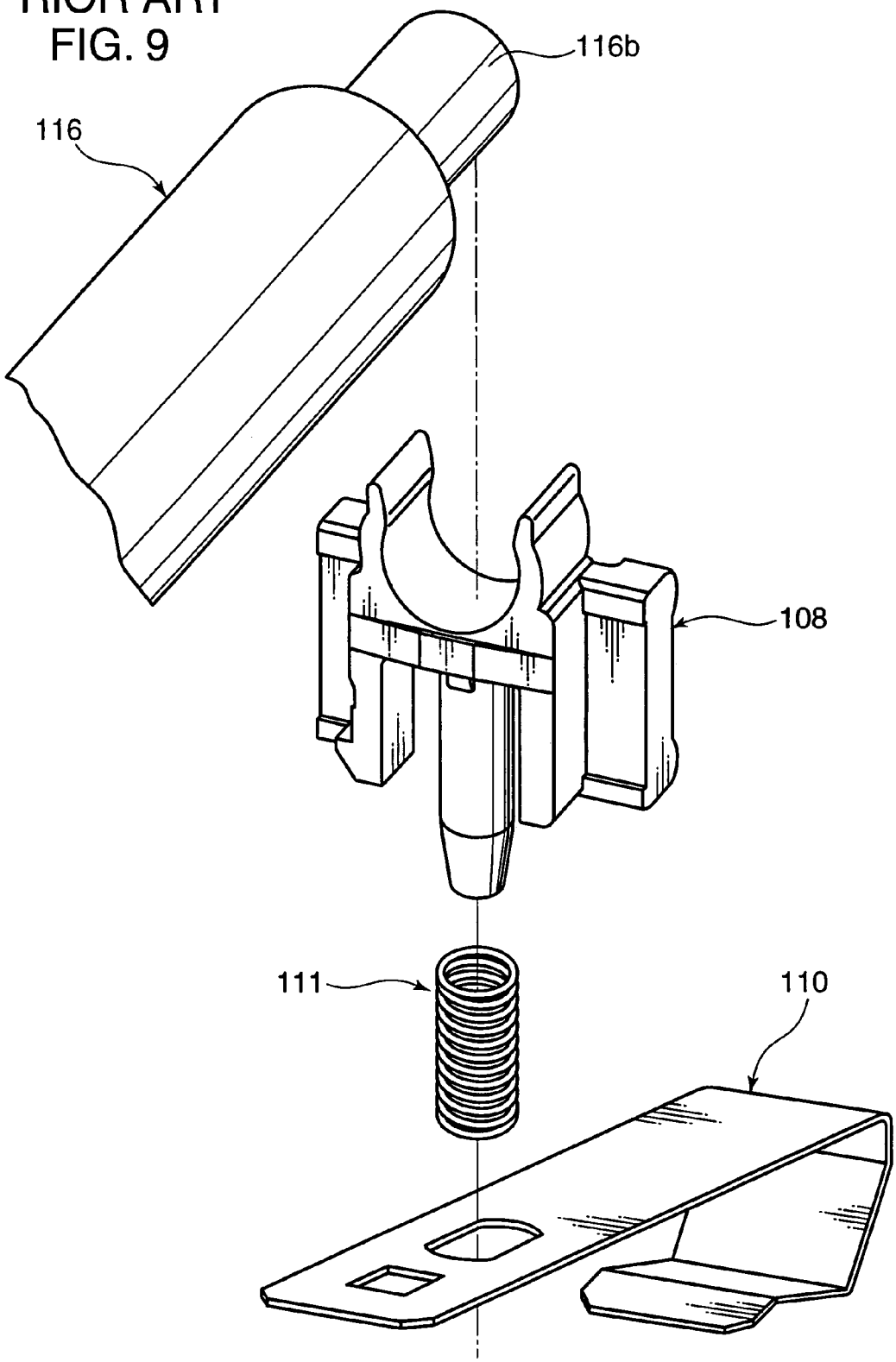
PRIOR ART FIG. 9
FIG. 9 is an exploded perspective view showing the conventional lifting mechanism of the transferring roller.

The bearing 8 is so configured as to axially support the roller shaft 16*b* of the primary transferring roller 16 in a state of being vertically slidably mounted on the casing 9. As shown in FIG. 7, the bearing 8 has a receiving portion 8*a* formed on the top portion, an inserting portion 8*b* continuously provided under the receiving portion 8*a*, engaging pieces 8*c* continuously provided on opposite sides of the inserting portion 8*b*, and a through hole 8*d* formed through the inserting portion 8*b*.

The receiving portion 8*a* is formed so as to receive the roller shaft 16*b* rotatably and have a substantially semi-arc shape which is open on upper side. The inserting portion 8*b* and the engaging pieces 8*c* which will be described herebelow are adapted to mount the bearing 8 to the casing 9 slidably in a vertical direction. The through hole 8*d* is formed so as to allow the strip member 10 to be inserted therethrough to make the strip member 10 come in contact with an upper end portion 8*e* of the through hole 8*d*.

The casing 9 is formed to have a box-like shape whose upper surface is open, and has a bottom surface portion 91, a side surface portion 92, and a projecting portion 93.

On the bottom surface portion 91, there are provided a pair of wall portions 91*a* extending along an axial direction of the primary transferring roller 16 and opposing each other at an interval slightly larger than a diameter of the primary transferring roller 16. At respective portions of the opposing surfaces of the wall portions 91*a* close to the side surface portion 92, there are formed a pair of retaining portion 91*b* which is perpendicular to the bottom surface portion 91 and to the wall portion 91*a*.

The retaining portions 91*b* are provided at an interval which substantially matches with a width of the inserting portion 8*b* of the bearing 8. Further, between each retaining portion 91*b* and the side surface portion 92, there is formed a space S for allowing the engaging piece 8*c* of the bearing 8 to be fitted from above. This allows the bearing 8 to be retained on the casing 9 slidably in a vertical direction.

In an area of the bottom surface portion 91 between the retaining portions 91*b*, there is formed an insertion hole 91*c*. The insertion hole 91*c* is adapted to allow the inserting portion 8*b* and a lower portion of the engaging piece 8*c* of the bearing 8 to be inserted therethrough. Insertion of the bearing 8 through the insertion hole 91*c* sets a horizontal position of the bearing 8 with respect to the casing 9. Further, at a position close to a center in the bottom surface portion 91 in the axial direction of the roller than the insertion hole 91*c*, there is formed an engaging projection 91*d* for engagement with the strip member 10.

The side surface portion 92 stands upward from a peripheral end portion of the bottom surface portion 91, and a slit 92*a* for allowing the strip member 10 to be inserted therethrough is formed in a lower portion of the side surface portion 92.

The projecting portion 93 is adapted to attach the strip member 10 and is continuously provided at the bottom surface portion 91 so as to project outward from the side surface portion 92.

The strip member 10 is formed by fabricating a single member made of stainless steel, and is attached to the casing 9 in a state of being inserted through the slit 92*a* of the side surface portion 92 and the through hole 8*d* of the bearing 8. The strip member 10 is formed to have a spring-like shape which comes in contact with an upper end portion 8*e* of the though hole 8*d* of the bearing 8 and pushes the bearing 8 upward. Further, the strip member 10 is so configured as to come in contact with other unit (unillustrated), and serves as a contact for supplying electricity to the primary transferring roller 16, in other words, serves as a contact for applying an electrical charge to a surface of the roller main body 16*a*.

Specifically, the strip member 10 has a engaging portion 10*a* engageable with the casing 9, a contact portion 10*b* which comes in contact with an upper end portion 8*e* of the through hole 8*d* of the bearing 8 from a lower side, and a connecting portion 10*c* for connecting the engaging portion 10*a* and the contact portion 10*b*.

An end portion of the engaging portion 10*a* has a shape of curved spring formed to be substantially folded U-shape, and the projecting portion 93 of the casing 9 is pinched vertically with this end portion so that the strip member 10 is attached to the casing 9. An outer peripheral surface of the curved part of the engaging portion 10*a* becomes a contact with other unit. Further, the engaging portion 10*a* is provided with an engaging portion 10*d* which engages with an engaging projection 91*d* of the casing 9. Engagement of the engaging projection 91*d* with the engaging portion 10*d* prevents the strip member 10 from disengaging from the casing 9.

The connecting portion 10*c* has a substantially U-shape to be elastically deformed in a direction of allowing the contact portion 10*b* to come close to and apart from the engaging portion 10*a*. In the assembled state of the lifting mechanism, the contact portion 10*b* is elastically deformed in a direction of coming close to the engaging portion 10*a*.

Thus, in the strip member 10 so configured as described above, a restoring force which relatively displaces the contact portion 10*b* to move apart from the engaging portion 10*a* (refer to an arrow in FIG. 6) occurs in the strip member 10, so that the contact portion 10*b* being in contact with the upper end portion 8*e* of the bearing 8 pushes the bearing 8 upward. This pushing-up action pushes the primary transferring roller 16 against the intermediate transferring belt 11. Further, since the restoring force is applied in a direction of pushing the engaging portion 10*a* toward the bottom surface portion 91 of the casing 9, the engagement of the engaging projection 91*d* with the engaging portion 10*d* becomes more assured.

Further, since the strip member 10 formed of a single member made of stainless steel comes in contact with other unit at its engaging portion 10*a* and also in contact with the bearing 8 at its contact portion 10*b*, electricity is supplied to the primary transferring roller 16 through the strip member 10 and the bearing 8.

In the present embodiment, as described above, the strip member 10 formed of a single member made of stainless steel can supply electricity to the primary transferring roller 16 through the bearing 8 and push the primary transferring roller 16 along with the bearing 8 upward to press the primary transferring roller 16 to the intermediate transferring belt 11. Thus, as compared to the conventional case of using the coil spring and a plate member, the number of parts can be reduced by omitting the coil spring. Further, in this case, since the number of parts constituting a passage for supplying electricity to the primary transferring roller 16 can be reduced, malfunction in electric current becomes unlikely to occur.

Figure 10:
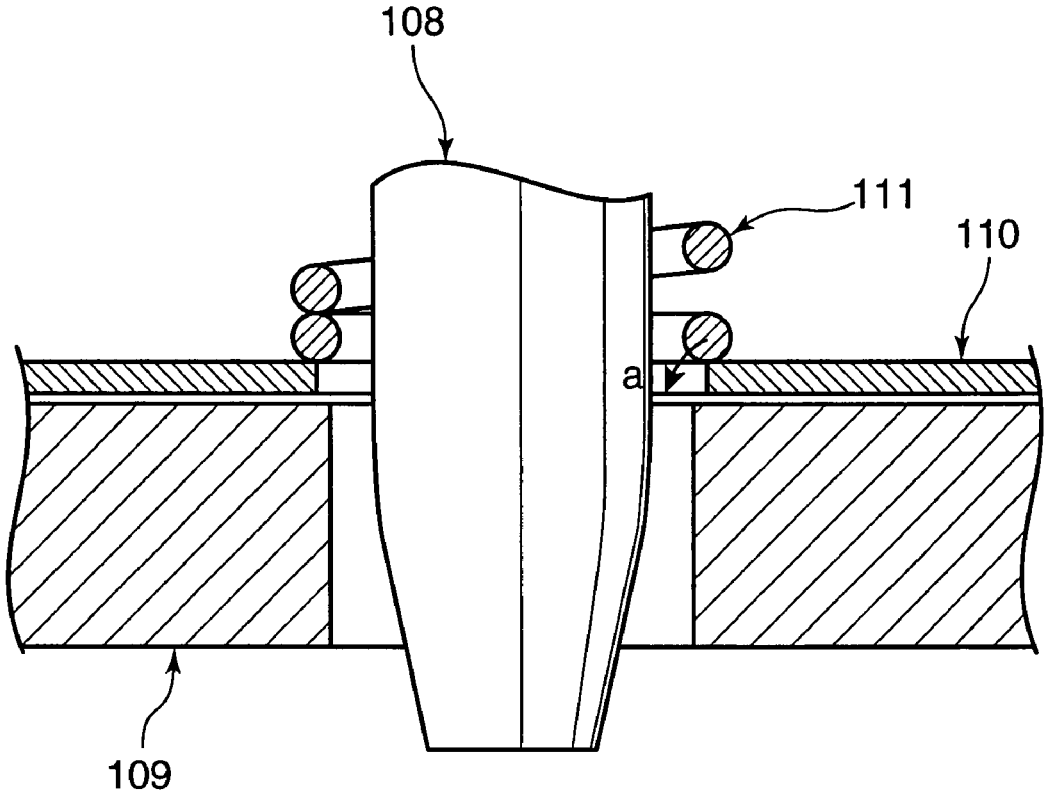
PRIOR ART FIG. 10
FIG. 10 is a schematic sectional view as a reference for descriptions of problems in the conventional lifting mechanism of the transferring roller.

In the configuration of using a coil spring like the conventional art, inconvenience may occur such that the coil spring 111 falls through (refer to an arrow "a") the through hole formed in the strip member 110 as shown in FIG. 10. However, a coil spring is not used in the configuration of the present embodiment. Accordingly, such inconvenience does not occur.

Further, in the assembled state of the strip member 10 in the present embodiment, the connecting portion 10*c* is so deformed in a direction of allowing the contact portion 10*b* to come close to the engaging portion 10*a*. Therefore, a restoring force of relatively moving the contact portion 10*b* apart from the engaging portion 10*a* is generated in the strip member 10. Thus, the contact portion 10*b* which comes in contact with the upper end portion 8*e* of the through hole 8*d* of the bearing 8 pushes the bearing 8 upward to press the primary transferring roller 16 to the intermediate transferring belt 11. This easily provides a spring force to the strip member 10 formed of a single member.

Further, the connecting portion 10*c* is formed to have a substantially U-shape in the present embodiment, so that the strip member 10 can be easily fabricated.

Furthermore, in the present embodiment, an example is shown where the roller member urging mechanism of the present invention is applied to a lifting mechanism for pressing the primary transferring roller 16 against the intermediate transferring belt 11. However, the present invention is not limited to this. The present invention may be applied to a lifting mechanism for pressing the secondary transferring roller 12 against the intermediate transferring belt 11, a lifting mechanism for a charging roller provided in the charging device 75, and the like.

In the above-described embodiment, an example is shown where the roller member urging mechanism of the present invention is applied to the color printer 1 provided with an image transferring portion 3 so configured that the image transferring unit 7 is provided above the intermediate transferring belt 11 and the primary transferring roller 16 comes in contact with the intermediate transferring belt 11 from the lower side, and the primary transferring roller 16 is urged upward along with the bearing. However, the present invention is not limited to this. The present invention may be applied to a printer provided with an image transferring portion so configured that the image transferring unit is arranged on the lower side of the intermediate transferring belt, and the primary transferring roller comes in contact with the intermediate transferring belt from the upper side, and the primary transferring roller is urged downward along with the bearing. Alternatively, the present invention may be applied to a printer having an image transferring unit so configured that the image transferring unit is arranged next to a vertically arranged intermediate transferring belt, and the primary transferring roller comes in contact with the intermediate transferring belt from a horizontal side, and the primary transferring roller is urged in a horizontal direction along with the bearing.

In the above-described embodiment, an example is shown where the connecting portion 10*c* is formed to have a substantially curved U-shape. The present invention is not limited to this. The connecting portion 10*c* may be formed to have a substantially folded U-shape provided with a spring.

In the above-described embodiment, an example is shown where the present invention is applied to a color printer as an example of an image forming apparatus. The present invention is not limited to this, and it may be applied not only to a color printer but may be applied to a monochromatic printer, a copying machine, a facsimile machine, a complex machine of these, and the like.

The above-described embodiment mainly includes the invention having the following configurations.

A roller member urging mechanism according to one aspect of the present invention comprises: a roller member having a roller shaft and coming in contact with a predetermined member; a casing for holding the roller member, the casing being electrically insulative; a bearing for receiving the roller shaft, the bearing being provided in the casing slidably in a direction substantially orthogonal to the roller shaft of the roller member, the bearing being electrically conductive; and a strip member provided in the casing near the bearing and serving as a contact for supplying electricity to the roller member, the strip member being a spring-like single member operable to come in contact with the bearing to press the roller member against the predetermined member through the bearing.

According to this configuration, the spring-like strip member formed of a single member can supply electricity to the roller member and press the roller member against other member through the bearing. Therefore, as compared to the conventional case of using a coil spring and a strip member, the number of parts can be reduced by omitting the coil spring. Further, in this case, the number of members constituting for supplying electricity to the roller member can be reduced, so that malfunction in electric current becomes unlikely to occur.

In the above-described configuration, it is preferable that the strip member includes: an engaging portion engageable with the casing; a contact portion which comes in contact with the bearing; and a connecting portion for connecting the engaging portion and the contact portion, and the connecting portion has such a shape as to be elastically deformable in a direction of allowing the contact portion to come close to and apart from the engaging portion, and is elastically deformed so as to allow the contact portion to come close to the engaging portion in a mounted state of the strip member.

According to this configuration, the connecting portion is elastically deformed in a direction of allowing the contact portion to come close to the engaging portion in the assembled state. Accordingly, a restoring force which allows the contact portion to relatively move apart from the engaging portion occurs. Thus, the contact portion being in contact with the bearing presses the roller member to other member through the bearing, so that a spring force can be easily provided to the strip member formed of a single member.

In this case, it is preferable that the connecting portion has a substantially U-shape. According to this configuration, the strip member can be easily fabricated.

In the above-described configuration, it is preferable that the plate member includes a single metal member having a substantially U-shape capable of providing a spring force.

In the above-described configuration, it is preferable that the plate member includes a single member having a substantially U-shape capable of providing a spring force, a flat part extending in one direction from the U-shape part for applying a pressure to the bearing, and a flat part extending in the other direction from the U-shape part for being engaged with the casing.

An image forming apparatus according to another aspect of the present invention comprises: a sheet supplying portion for supplying a sheet; an image transferring portion having a transferring roller for transferring an image onto a sheet supplied by the sheet supplying portion; a casing for holding the transferring roller, the casing being electrically insulative; a bearing for receiving the roller shaft, the bearing being provided in the casing slidably in a direction substantially orthogonal to the roller shaft of the transferring roller, the bearing being electrically conductive; and a strip member provided in the casing near the bearing and serving as a contact for supplying electricity to the roller member, the strip member being a spring-like single plate member operable to come in contact with the bearing to urge the transferring roller toward a predetermined direction through the bearing.

An image forming apparatus according to yet another aspect of the present invention comprises: a photoconductive drum having a peripheral surface on which a toner image is formed; an intermediate image bearing member onto which the toner image formed on the peripheral surface of the photoconductive drum is transferred; a transferring roller arranged in contact with the intermediate image bearing member to perform the transfer of the toner image; a casing for holding the transferring roller, the casing being electrically insulative; a bearing for receiving the roller shaft, the bearing being provided in the casing slidably in a direction substantially orthogonal to the roller shaft of the transferring roller, the bearing being electrically conductive; and a strip member provided in the casing near the bearing and serving as a contact for supplying electricity to the roller member, the strip member being a spring-like single member operable to come in contact with the bearing to urge the transferring roller to the intermediate image bearing member through the bearing.

This application is based on Japanese Patent application serial No. 2006-295098 filed in Japan Patent Office on Oct. 31, 2006, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. A roller member urging mechanism comprising:

a roller member having a roller shaft and coming in contact with a predetermined member;

a casing for holding the roller member, the casing being electrically insulative;

a bearing for receiving the roller shaft, the bearing being provided in the casing slidably in a direction substantially orthogonal to the roller shaft of the roller member, the bearing electrically conductive; and a strip member provided in the casing near the bearing and serving as a contact for supplying electricity to the roller member, the strip member being a member operable to come in contact with the bearing to press the roller member against the predetermined member through the bearing, wherein the strip member includes a single metal member having a substantially U-shape capable of providing a spring force.

2. A roller member urging mechanism, comprising:

a roller member having a roller shaft and coming in contact with a predetermined member;

a casing for holding the roller member, the casing being electrically insulative;

a bearing for receiving the roller shaft, the bearing being provided in the casing slidably in a direction substantially orthogonal to the roller shaft of the roller member, the bearing being electrically conductive; and a strip member provided in the casing near the bearing and serving as a contact for supplying electricity to the roller member, the strip member being a spring-like single member operable to come in contact with the bearing to press the roller member against the predetermined member through the bearing, wherein the strip member includes an engaging portion enqageable with the casing, a contact portion which comes in contact with the bearing, and a connecting portion for connecting the engaging portion and the contact portion, and the connecting portion has such a shape as to be elastically deformable in a direction of allowing the contact portion to come close to and apart from the engaging portion, and is elastically deformed so as to allow the contact portion to come close to the engaging portion in a mounted state of the strip member.

3. The roller member urging mechanism according to claim 1, wherein the connecting portion has a substantially U-shape.

4. A roller member urging mechanism comprising:

a roller member having a roller shaft and coming in contact with a predetermined member;

a casing for holding the roller member, the casing being electrically insulative;

a bearing for receiving the roller shaft, the bearing being provided in the casing slidably in a direction substantially orthogonal to the roller shaft of the roller member, the bearing electrically conductive; and a strip member provided in the casing near the bearing and serving as a contact for supplying electricity to the roller member, the strip member being a member operable to come in contact with the bearing to press the roller member against the predetermined member through the bearing, wherein the strip member includes a single member having a substantially U-shape capable of providing a spring force, a flat part extending in one direction from the U-shape part for applying a pressure to the bearing, and a flat part extending in the other direction from the U-shape part for being engaged with the casing.

5. An image forming apparatus, comprising:

a sheet supplying portion for supplying a sheet;

an image transferring portion having a transferring roller for transferring an image onto a sheet supplied by the sheet supplying portion, the transferring roller having a roller shaft;

a casing for holding the transferring roller, the casing being electrically insulative;

a bearing for receiving the roller shaft, the bearing being provided in the casing slidably in a direction substantially orthogonal to the roller shaft of the transferring roller, the bearing being electrically conductive; and a strip member provided in the casing near the bearing and serving as a contact for supplying electricity to the transferring roller, the strip member being operable to come in contact with the bearing to urge the transferring roller toward a predetermined direction through the bearing, wherein the strip member includes a single metal member having a substantially U-shape capable of providing a spring force.

6. The image forming apparatus according to claim 5, wherein:

the strip member includes:

an engaging portion engageable with the casing;

a contact portion which comes in contact with the bearing; and a connecting portion for connecting the engaging portion and the contact portion, and the connecting portion has such a shape as to be elastically deformable in a direction of allowing the contact portion to come close to and apart from the engaging portion, and is elastically deformed so as to allow the contact portion to come close to the engaging portion in a mounted state of the strip member.

7. The image forming apparatus according to claim 5, wherein a plate member includes a flat part extending in one direction from a U-shape part for applying a pressure to the bearing, and a flat part extending in the other direction from the U-shape part for being engaged with the casing.

8. An image forming apparatus, comprising:

a photoconductive drum having a peripheral surface on which a toner image is formed;

an intermediate image bearing member onto which the toner image formed on the peripheral surface of the photoconductive drum is transferred;

a transferring roller arranged in contact with the intermediate image bearing member to perform the transfer of the toner image, the transferring roller having a roller shaft;

a casing for holding the transferring roller, the casing being electrically insulative;

a bearing for receiving the roller shaft, the bearing being provided in the casing slidably in a direction substantially orthogonal to the roller shaft of the transferring roller, the bearing being electrically conductive; and a strip member provided in the casing near the bearing and serving as a contact for supplying electricity to the transferring roller, the strip member being member operable to come in contact with the bearing to urge the transferring roller to the intermediate image bearing member through the bearing, wherein the strip member includes a single metal member having a substantially U-shape capable of providing a spring force.

9. The image forming apparatus according to claim 8, wherein:

the strip member includes:

an engaging portion engageable with the casing;

a contact portion which comes in contact with the bearing; and a connecting portion for connecting the engaging portion and the contact portion, and the connecting portion has such a shape as to be elastically deformable in a direction of allowing the contact portion to come close to and apart from the engaging portion, and is elastically deformed so as to allow the contact portion to come close to the engaging portion in a mounted state of a plate member.

10. The image forming apparatus according to claim 8, wherein the strip member includes a flat part extending in one direction from a U-shape part for applying a pressure to the bearing, and a flat part extending in the other direction from the U-shape part for being engaged with the casing.

* * * * *